US007455257B1

(12) United States Patent
Kaleta

(10) Patent No.: US 7,455,257 B1
(45) Date of Patent: Nov. 25, 2008

(54) MOTORIZED SELF-WINDING REEL FOR DIVERS

(76) Inventor: Dennis Alfred Kaleta, 826 Hemlock St., Shamokin, PA (US) 17872

( * ) Notice: Subject to any disclaimer, the term of this patent is extended or adjusted under 35 U.S.C. 154(b) by 192 days.

(21) Appl. No.: 11/520,887

(22) Filed: Sep. 13, 2006

(51) Int. Cl.
*B65H 27/00* (2006.01)
*B63B 22/18* (2006.01)

(52) U.S. Cl. ..... 242/397.3; 441/25

(58) Field of Classification Search ..... 242/390.8, 242/397.2–397.3, 412.2, 413.3, 273, 241; 441/23–26

See application file for complete search history.

(56) References Cited

U.S. PATENT DOCUMENTS 3,815,846 A * 6/1974 Biewer ..... 242/478.2
4,235,394 A * 11/1980 Fry ..... 242/397.3
4,334,670 A * 6/1982 Kawabe ..... 254/346
4,756,486 A 7/1988 Campbell
4,767,073 A * 8/1988 Malzacher ..... 242/414
5,173,067 A 12/1992 Biba
5,238,201 A 8/1993 Jonushaitis
5,640,922 A 6/1997 Feldkamp et al.
5,938,140 A 8/1999 Fundak
6,807,127 B2 10/2004 McGeever, Jr.
6,834,459 B2 12/2004 van Weenen
7,344,103 B1 * 3/2008 Eley ..... 242/397.2

* cited by examiner

*Primary Examiner*—Peter M Cuomo
*Assistant Examiner*—Sang Kim
(74) *Attorney, Agent, or Firm*—Wendy W. Koba

(57) ABSTRACT

An automated reel for use by divers comprises a battery-operated motor in communication with a take-up reel through a gearing arrangement, where the activation/de-activation of the motor is controlled by a tension-sensing mechanism. In operation, when the mechanism senses that there is "slack" in the safety cord, the mechanism will turn "on" the motor, which will then cause the reel to rotate (via the gearing arrangement) to wind up the slack safety cord. Once tension is restored on the line, the mechanism will turn "off" the motor. A manual override switch may be included for situations where the diver desires to retain control of winding/unwinding of the safety cord. A line leveler arrangement may be used in conjunction with the reel so as to evenly distribute the safety cord across the extent of the reel.

10 Claims, 4 Drawing Sheets

MOTORIZED SELF-WINDING REEL FOR DIVERS

TECHNICAL FIELD

The present invention relates to a diver's reel and, more particularly, to a diver's reel including a self-contained, battery-operated take-up reel that allows a sufficient length of safety cord to play out while a diver is moving away from his starting location and a tension-sensing device that automatically reels in a portion of the safety cord as soon as slack cord is created (as when the diver begins to return to his starting position).

BACKGROUND OF THE INVENTION

Poor visibility can greatly reduce the ability of a diver to return to a dive boat (or shore location) on his ascent. Safety guide lines, or cords, have been provided in the prior art on reels that are carried by the diver. In use, the diver follows the guide line to return to the exact origin of descent. These reels require attention and constant winding/unwinding by the diver during underwater activity to so as to maintain a direct line back to his ascent location, which is considered to be both distracting and counter-productive to the activities in which the diver may be involved. Additionally, reels that do not include some type of "line leveler" device may become tangled and, as a result, less line can be stored on the reel because of inefficient distribution of the line across the reel. Prior art devices do not adequately address these problems.

U.S. Pat. No. 5,067,920, issued to Brisky on Nov. 26, 1991, puts forth a device flag line dispenser apparatus which comprises a hand-held line and reeling structure arranged in combination with a flotation buoy typically utilized in diving events. A tether line is secured to the dive buoy at one end and wound about a hand-held portable device to effect winding and reeling of the tether line to permit ease of return of a diver to the flotation buoy. The winding and reeling device further includes a separate cage member, including a spool formed with a triangular cross-sectional configuration groove to receive in a convenient and non-snap manner the tether line that is directed through a generally triangular opening formed within the cage head.

U.S. Pat. No. 6,791,490 issued to King on Sep. 14, 2004, discloses a scuba diving flag/float assembly that is used to support a GPS antenna on the surface of the water for use by divers in performing underwater navigation. An associated GPS receiver is integrated with a dive flag line take-up mechanism, such as a spool or scuba diving line reel. The dive flag line and cable interconnecting the GPS receiver to the GPS antenna is integrated within a single assembly, or in an alternative embodiment, braided together forming a single tether. Other embodiments include optional sensors such as a flowmeter, compass, tiltmeter, depth gauge and others to compensate for navigational errors due to a water current pushing a dive flag/float away from a diver. Alternatively, a GPS receiver may be mounted on (or in) the dive flag/float assembly, with navigational information relayed to the diver under the water.

U.S. Pat. No. 3,705,697 issued to Chagnon on Dec. 12, 1972, discloses a scuba diving reel that straps to the forearm of a diver and includes a wedging means to fix the unwound line at a particular length.

U.S. Pat. No. 5,238,201 issued to Jonushaitis on Aug. 24, 1993, teaches a mobile hand-held line reel apparatus for feed out, and uptake of a line comprising a base member, an axle extending from the base member, a spool rotatably mounted on the axle, a spool retainer, a line retainer, a brake lever mounted on threadably engaging the axle, and a brake lever movement limiting projection. The brake lever can be operated by the same hand that holds the reel. The brake lever is threadably mounted on the axle next to the spool and when the brake lever is moved through a braking stroke, the lever and spool move along the axle, thus increasing the friction between the brake lever and the spool as well as between the spool and a fixed element of the reel.

U.S. Pat. No. 4,756,486 issued to Campbell on Jul. 12, 1988 defines a scuba diving reel comprising a hand-held frame rotatably mounting a line receiving spool on which a length of line is wound. A coupling member is provided on the terminal end of the line for attaching the line to an object such as a buoy so that when the scuba diver moves away from the buoy, the spool will rotate and pay out the line. An anti-backlash mechanism is provided for preventing the free-wheeling of the spool when tension force thereon is removed. A rotatable pinch mechanism is provided for maintaining taut the line portion between the pinch mechanism and the spool.

U.S. Pat. No. 5,173,067 issued to Biba on Dec. 22, 1992 and describes a scuba diving take-up reel which comprises a plastic spool rotatably mounted between the two plastic halves of a housing. A spring motor is mounted to the housing and engages with a gear train connected to the housing such that a spring will sufficient to retract a length of line ten times as long connected to the spool and windable thereon. The housing has an opening which allows the entrance of water. The line is connected to a floating surface buoy and is automatically extended as a scuba diver descends to lower aquatic depths. Vanes extend radially from the spool and cooperate with the water to resist too rapid rewinding of the line onto the spool as a diver ascends. The housing has a hook-shaped handle for restraining of the reel and also has a clip which retains a writing instrument which may be used for underwater communication between divers by writing on a planar surface of the housing.

U.S. Pat. No. 5,938,140 issued to Fundak on Aug. 17, 1999 and discloses a multi-purpose dive reel that automates underwater line handling. The improved multi-purpose dive reel includes an anti-fouling line control system comprising a flexible line wiper and line exit guide. The reel is manufactured using a high impact reinforced polymer construction that is lightweight, inexpensive and not affected by the often corrosive marine environment. The improved dive reel has an on/off spool lock switch and contoured smooth surface including a comfort grip containing a lanyard attachment loop. Optionally, the reel may further include a ratcheting spool lock switch, a luminous polymer pigment and a wave-washer spool tension control.

U.S. Pat. No. 5,803,780 issued to Gutierrez, Jr. on Sep. 9, 1998 and discloses a compact integrated marking buoy device with a self-adjusting integral reel that enables a person to easily mark a location on the seabed with a floating buoy. The buoy device includes a line control mechanism that enables the device, once placed in the water, to release the weight and automatically pay out only sufficient line to connect the buoy at the surface to the weight at the seabed, while preventing the release of any excess line once the weight has reached the seabed. The device permits paying out of additional line once the level of tension on the line again exceeds the threshold. The device further allows for easy retrieval of the weight and line through means internal to the marking buoy.

U.S. Pat. No. 5,640,922, issued to Feldkamp on Jun. 24, 1997, illustrates a hands-free dive flag connector comprising a retractable lanyard dispenser releasably attached to device gear on a scuba diver. Complementary hook and loop materials are attached to the dive gear and the retractable lanyard dispenser to form a releasable connection between the diver and the hands-free dive flag connector. A lanyard is retractably wound on a spool in the retractable lanyard dispenser and attached to the spool at a dispenser end. A spring in the retractable lanyard dispenser maintains tension on the lanyard between the diver and the dive flag attached to the lanyard. A lanyard connector is attached to the second end of the lanyard adjacent to an extended lanyard portion extending from the lanyard dispenser. The lanyard connector attaches to the dive flag.

U.S. Pat. No. 3,907,236, issued to Sims, Jr. on Sep. 23, 1975, discloses an elongated life line reel that may be used by a scuba diver to contain a length of line secured at one end to the reel, and at the other end to a float, so that at all times the diver's presence is known. As the diver descends, the line is unwound (or removed) from the reel, which is secured about his arm or leg by means of a pair of flexible straps respectively attached to the reel by a pair of spring members. The elongated shape of the reel allows the reel to fit securely on the forearm or leg of the diver, contains a long length of line and allows unrestricted movement of the diver in the water. The spring member's function is to permit easy attaching of the reel to the arm or leg and will operate to maintain the reel about the arm or leg at the different underwater pressures encountered by the diver.

U.S. Pat. No. 3,832,746, issued to Korsgaard on Sep. 3, 1974, provides a float tow guide line that includes a forwardly-located reel for storage of a line, and a rearwardly-located handle for guiding the line to a centrally located passage means. This arrangement allows for varying lengths of line to be stored by the handle while at the same time providing a centrally located line discharge means to prevent twisting of the handle during use.

U.S. Pat. No. 5,328,298, issued to Maffatone on Jul. 12, 1994, concerns a safe ascent/decompression device for use in diving with an inflatable lift bag, including a pack for securing the ascent/decompression device on a diving harness worn by a diver. The device comprises a reel mounted for rotation to the pack and having a decompression line wound thereabout, the decompression line being connected to the lift bag; a cable having a first end and a second loop end; a snap shackle connected with the first end and releasably holding the loop end to secure the cable about a ship wreck, the snap shackle including a main section having an open side, a closure lever pivotally connected to the main section for movement between closed and open positions, and a spring-biased pin for releasably locking the closure lever in the closed position; a first release clip for receiving the decompression line to limit a rate of ascent of the lift bag connected to the decompression line, and being connected to the cable; a second release clip secured to the pack for engaging with the spring-biased pin of the snap shackle; an ascender, connected to the pack, for grabbing onto and moving along the rope in only one direction; and a spider for riding along a section of the decompression line extending between the lift bag when inflated and the reel, and for grabbing the ascender. The spider is connectable to a pull line for pulling the spider, and thereby the ascender, upwardly along the section of the decompression line.

In spite of these various devices and arrangements, a need remains in the art for a safety guide line that is hands-free and yet automatically takes up slack line as a diver returns/ascends upwardly to his point of origin.

SUMMARY OF THE INVENTION

The need remaining in the prior art is addressed by the present invention, which relates to a diver's reel and, more particularly, to a diver's reel including a self-contained battery-operated take-up reel that allows a sufficient length of safety cord to play out while a diver is moving away from his starting location and a tension-sensing device that automatically reels in a portion of the safety cord as soon as slack cord is created (as when the diver begins to return to his starting position).

In accordance with the present invention, a motorized, self-winding diver's reel comprises a reel that holds a predetermined length of safety guide cord to be used by a scuba diver, an attaching device at the distal end of the safety guide cord for attachment to an anchor line (or boat), a cord tension sensor and circuit to turn an associated motor "on" and "off", and a battery-powered electric motor housing in a waterproof compartment, to allow for a length of safety guide cord to pay out while moving away from the anchor point, and also automatically reeling in the slack cord that is created while moving toward the anchor point, thus maintaining a direct guide-line return to this point.

An object of the present invention is to provide a line leveler for even distribution of the line over the entire reel to prevent tangling of the line, thus allowing for more line to be wound on the reel.

Another important object of the present invention is to provide an automatic motorized self-winding safety guide line reel for divers for maintaining a direct safety guide line back to the diver's anchor point automatically.

Another object of the present invention is to provide divers with a way to keep both hands free when returning to their point of origin.

In brief, a guide line reel is connected by gears to a battery-driven electric motor contained in a water-tight housing. The housing clips onto the gear of a diver by means of, for example, a D-ring connected to the diver's equipment, such as a buoyancy compensator device. The exposed end of the guide line clips onto an anchor point (e.g., the diver's point of origin). When the diver is swimming back to the point of origin, the tension on the line is released, causing a tension sensing mechanism on the housing to activate the motor and wind the guide line onto the guide line reel, removing any slack in the line, thereby keeping the diver on a direct course back to the point of origin. When the diver is moving away from the point of origin, the diver may loosen the drag on the reel to allow the line to unreel easily with the sensor disengaged and may engage the sensor and disengage the sensor as line is needed to be reeled in or unreeled during different operations of underwater exploration.

Other and further objects and advantages of the present invention will become apparent during the course of the following discussion and by reference to the accompanying drawings.

BRIEF DESCRIPTION OF THE DRAWINGS

Referring now to the drawings, where like numerals represent like parts in several views.

DETAILED DESCRIPTION

Figure 1:
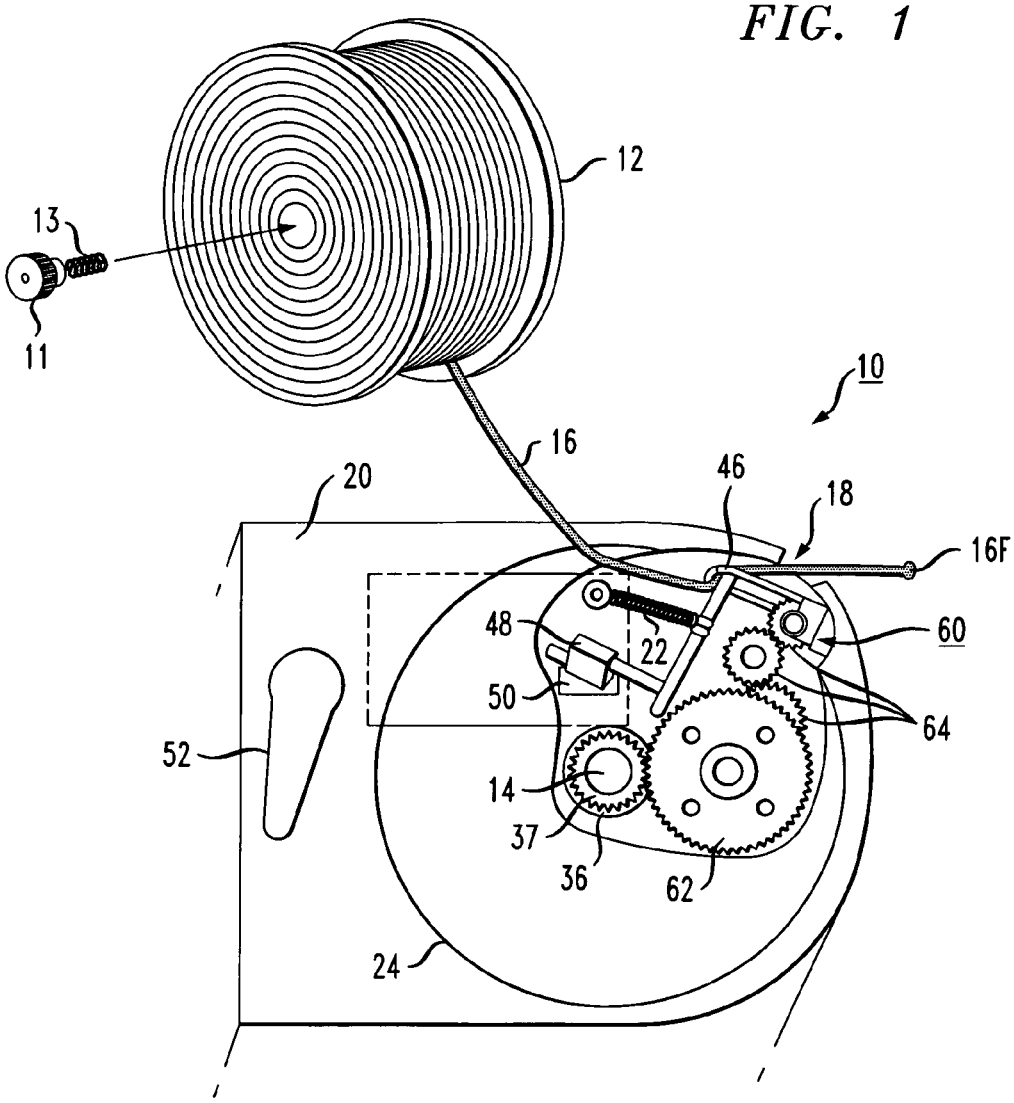
FIG. 1 is a perspective view of the motorized, self-winding safety guide line reel of the present invention, where the take-up reel is removed to illustrate various internal components of the inventive guide line reel.

FIG. 1 illustrates, in a side (exploded) view, an exemplary motorized self-winding diver's reel 10 formed in accordance with the present invention. For illustrative purposes, take-up reel 12 has been removed from an associated axle 14 to clearly illustrate the various components utilized to form the self-winding portion of the inventive reel. As shown, a length of safety cord 16 is wound around take-up reel 12. When take-up reel 12 is in place over axle 14, the free end of cord 16 (denoted 16-F in FIGS. 1 and 2), is fed through an opening 18 in housing 20 of self-winding reel 10 and is thereafter attached to a diver's anchor line at a fixed point. Shown in association with take-up reel 12 is a tension knob 11 and a spring 13 that are inserted through the central aperture of take-up reel 12 so as to fit against axle 14. When take-up reel 12 is in place (as shown in FIG. 3), knob 11 can be turned to adjust the force that spring 13 applies against axle 14. This force will control the tension associated with the winding and unwinding of cord 16 on take-up reel 12. Illustrated in the cut-away portion of self-winding reel 10 are some of the components forming tension-sensing arrangement 22 and automatic line leveler 60. In general, tension-sensing arrangement 22 of the present invention allows for the different between "slack" and "taut" to be discerned and used to control the turning "on" and "off" of the take-up reel mechanism. Line leveler 60, which may be used with or without tension-sensing arrangement 22, is a geared arrangement for evenly distributing cord 16 as it is wound onto take-up reel 12.

Figure 2:
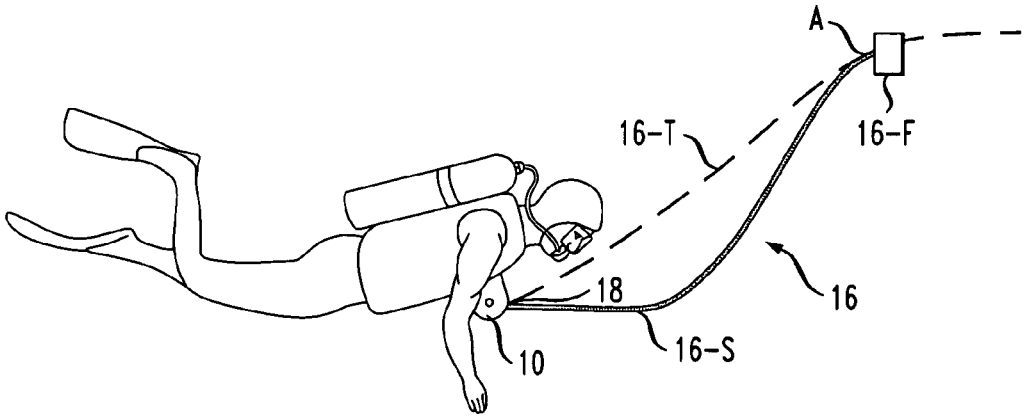
FIG. 2 is a simplified illustration of self-winding safety guide line reel of the present invention as used by a diver.
Figure 3:
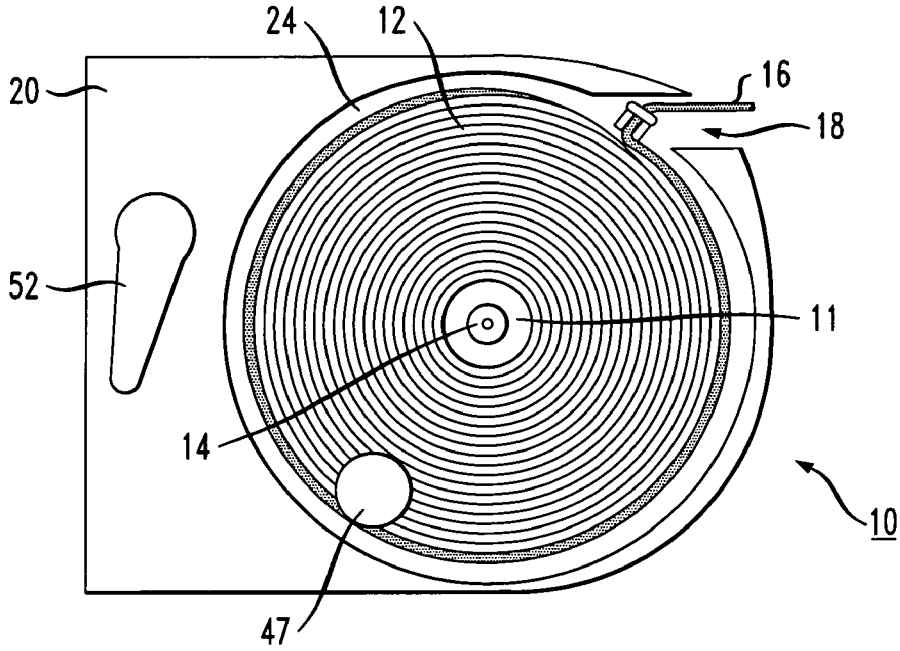
FIG. 3 is an exposed side view of an exemplary guide line reel of the present invention, illustrating the placement of the take-up reel within the housing of the device.

FIG. 2 illustrates an exemplary application of self-winding diver's reel 10, with free end 16-F of cord 16 shown as attached to fixed point A, which may be any suitable location for use as an anchor point by a diver. As shown, an advantage of self-winding reel 10 of the present invention is that it permits "hands-free" operation, allowing the diver full mobility without having to perform any winding/unwinding by hand.

In accordance with the present invention, as long as a diver is moving away from point A, cord 16 will remain taut and continue to pay out from reel 12. However, as soon as a diver begins to move back towards point A, cord 16 will go slack, as shown in FIG. 2. That is, dotted line 16-T illustrates safety cord 16 in its "taut" position and solid line 16-S illustrates safety cord 16 in its "slack" position. As soon as safety cord 16 goes slack, the release of tension between cord 16 and take-up reel 12 is sensed by spring-loaded tension-sensing arrangement 22 (as explained in further detail below), which then activates a battery-operated motor and associated gearing to automatically re-wind slack cord 16 back onto take-up reel 12. The operation of spring-loaded tension-sensing arrangement 22 will be described in further detail hereinbelow.

FIG. 3 is a side view of self-winding diver's reel 10 of the present invention, with take-up reel 12 inserted over axle 14 and disposed in place within a first cavity 24. As shown, safety cord 16 will enter and exit self-winding diver's reel 10 through an aperture 18 formed within housing 20.

Figure 4:
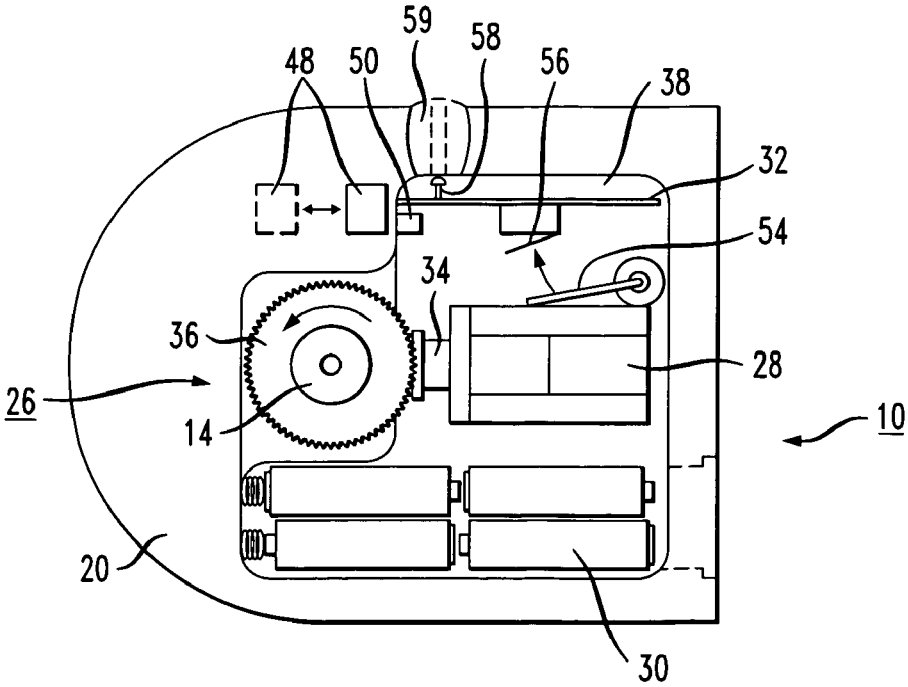
FIG. 4 is an side view of the opposing side of the inventive self-winding safety guide line reel, illustrating the location of the battery-operated rotary motor and related components.

FIG. 4 is a cut-away view of the opposing side of self-winding diver's reel 10 of the present invention, illustrating in particular various components of tension-sensing arrangement 22, including an exemplary motor configuration 26 that is used to wind slack cord 16 back onto take-up reel 12. Motor configuration 26 comprises a rotary motor 28, a battery source 30 for supplying power to rotary motor 28 and a tension-sensing circuit 32. As will be described in detail herein below, as soon as tension-sensing circuit 32 receives a control signal denoting presence of slack in cord 16, circuit 32 will turn "on" rotary motor 28. In this particular embodiment, rotary motor 28 will then cause a first gear 34 to rotate. First gear 34 is meshed with a second gear 36 that is attached to shaft 14 of take-up reel 12 (not shown). Therefore, as first gear 34 rotates, second gear 36 will rotate in the direction of the arrow shown in FIG. 4. The rotation of second gear 36 causes attached take-up 12 to similarly rotate, since shaft 14 of take-up reel 12 is fixed to second gear 36, in the manner as discussed above in association with FIG. 1. As long as "slack" remains in safety cord 16, tension-sensing circuit 32 will maintain rotary motor 28 in the "on" position so as to continue to wind the slack cord 16 back onto take-up reel 12.

As soon as all slack cord 16 has been rewound, a tension force will again return between cord 16 and take-up reel 12, as discussed in detail below. The presence of this tension force is sensed by circuit 32, which then turns "off" motor 28 and prevents any further re-winding of cord 16. In accordance with the present invention, motor configuration 26 is disposed within a water-tight second cavity 38 formed within housing 20, where second cavity 38 is disposed through the opposing side of housing 20 with respect to first cavity 24, resulting in a relatively compact self-winding reel 10 that may easily be attached to a diver's suit without interfering with the diver's underwater activities.

Figure 5:
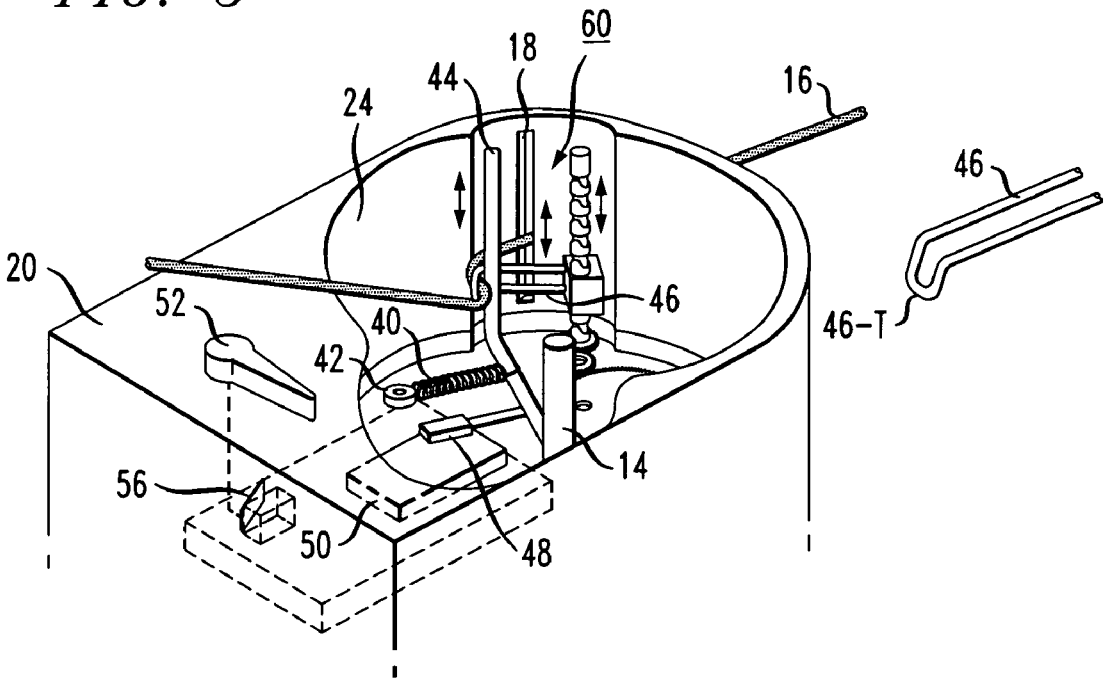
FIG. 5 is an isometric view of various internal components of the self-winding safety guide line reel of the present invention, illustrating the guide cord in its "slack" mode where the tension-sensing device has activated the motor to begin re-winding in slack cord.
Figure 6:
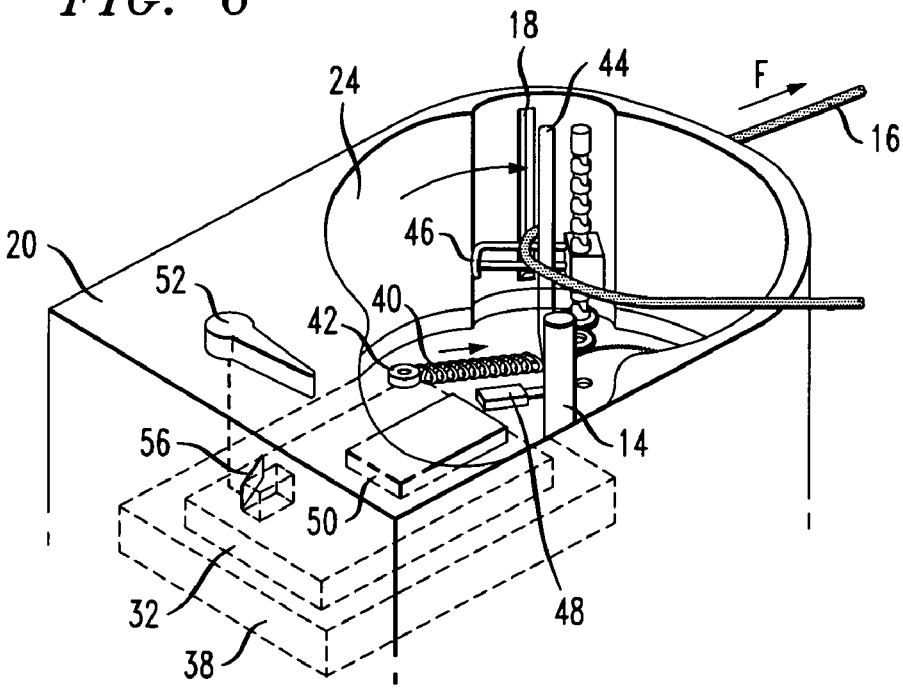
FIG. 6 is another isometric view, similar to FIG. 5, in this case illustrating the guide cord in its "taut" mode, with the take-up reel being de-activated and allowing the cord to unreel from the take-up reel.

FIGS. 5 and 6 contain isometric views of self-winding reel 10 in the "slack cord" and "taut cord" modes, respectively, which may be used to further explain the operation of spring-loaded tension-sensing arrangement 22 in conjunction with tension-sensing circuit 32 to automatically control the re-winding operation of the present invention. Referring first to FIG. 5, spring-loaded tension-sensing arrangement 22 is illustrated as including a spring 40, held fixed at a first end by a fixed attachment element 42 (such as a screw). The opposing end of spring 40 is inserted over an L-shaped arm 44. A U-shaped cord guide 46 is disposed in association with L-shaped arm 44 in the manner shown, where cord 16 is fed through guide 46 as it is unwound from take-up reel 12 (not shown). U-shaped cord guide 46 includes a right-angle bend at its termination (denoted 64-T in the drawing) to provide a tensive force against cord 16 as it is guided. Cord 16 passes through guide 46 and exits device 10 through aperture 18 as discussed above. Also attached to L-shaped arm 44 is a magnetic element 48 that is used to provide the activation of tension-sensing circuit 32 through an interaction with a magnetic relay 50 included within circuit 32.

When cord 16 includes "slack", spring 40 will be in its relaxed, fully compressed position, as shown in FIG. 5. Thus, in accordance with the present invention, magnetic element 48 will be located adjacent magnetic relay component 50 of circuit 32, causing circuit 32 to activate rotary motor 28 in the manner discussed above to initiate the rotation of take-up reel 12. Therefore, as long as "slack" in cord 16 is "sensed" by spring 40 remaining compressed, magnetic element 48 will remain in position next to relay 50 of circuit 32 and maintain motor 28 in its "on" position. This positioning of magnetic element 48 and relay 50 is best shown in FIG. 4, where element 48 is shown both adjacent to relay 50 and (in phantom) removed from relay 50, the latter positioning associated with the "taut" mode of cord 16, as discussed hereinbelow in association with FIG. 6.

Once safety cord 16 again becomes taut, as particularly illustrated in FIG. 6, the return of the tensive force will cause spring 40 to stretch and rotate L-shaped arm 44 in the direction as shown. Inasmuch as magnetic element 48 is attached to L-shaped arm 44, magnetic element 48 will also move when tension returns. In accordance with the present invention, magnetic relay element 50 of circuit 32 is properly disposed such that as magnetic element 48 moves, it moves away from relay 50 and becomes magnetically de-coupled from magnetic relay element 50. This positioning of magnetic element 48 vis-à-vis relay 50 is shown in phantom in FIG. 6. As a result, relay element 50 will be deactivated and cause rotary motor 28 to turn "off". By virtue of motor 28 turning "off", second gear 36 will no longer rotate and take-up reel 12 come to a stop, preventing any additional cord 16 from winding onto take-up reel 12.

As an additional feature, reel 10 of the present invention may include a "disable" switch 52 controllable by a diver to override the operation of tension-sensing arrangement 22 and allow the diver to manually control the pay out and winding of cord 16. FIGS. 1, 3, 5 and 6 illustrate an exemplary disable switch 52 that is disposed on an external portion of housing 20, preferably in a location that is easily accessible by a diver. Disable switch 52 is attached, through the thickness of housing 20, to an internal lever arm 54, as shown in FIG. 4. As shown in FIG. 4, when lever arm 54 rotates in the direction of the arrow, it will activate a switch 56 within tension-sensing circuit 32 to engage the operation of magnetic relay 50. By engaging magnetic relay 50, the position of magnetic element 48 (which, as described above, is a function of whether or not there is tension on safety cord 16) will not control the turning "on" or "off" of motor 28. That is, motor 28 will remain "off" regardless of the position of magnetic element 48 (that is, regardless of the presence or absence of slack along safety cord 16). In this case, an external handle 47 coupled to take-up reel 12 (as shown in FIG. 3) may be used to control the winding/unwinding of cord 16 by the diver himself.

When such a "disable" switch 52 is utilized with reel 10 of the present invention, a particularly advantageous embodiment includes a visible indicator 58, such as an LED, that allows a diver to know that the automatic re-wind capability of device 10 has indeed been disabled (a safety precaution for instances where the "disable" switch may be accidentally thrown). In the particular arrangement as shown in FIG. 4, LED indicator 58 is also formed as a portion of tension-sensing circuit 32, where as soon as switch 56 closes, LED indicator 58 is illuminated. A transparent insert 59 formed within the portion of housing 20 directly in line with LED indicator 58 to allow for the visible output from the LED to be visible to the diver.

Figure 7:
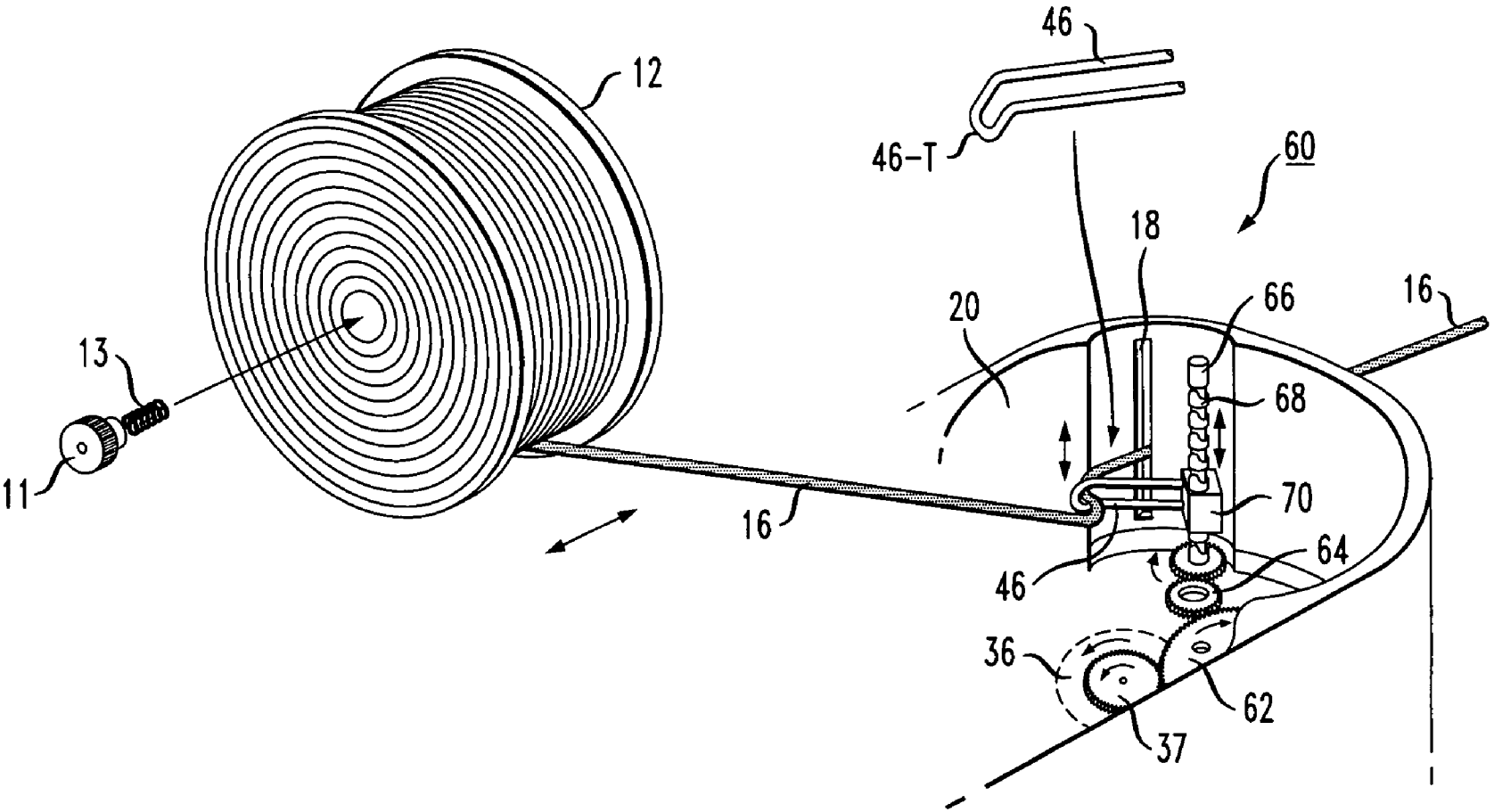
FIG. 7 is an isometric view of an embodiment of the present invention utilizing a line leveler arrangement, working in conjunction with the motorized gearing, to evenly distribute the line across the take-up reel as the reel rotates.

Another important aspect of the present invention is that a line leveler arrangement 60 may be included with device 10 to ensure that cord 16 feeds evenly onto take-up reel 12 for efficient operation. Indeed, it is an aspect of the present invention that line leveler arrangement 60 may be used with either a manual operation of take-up reel 12 (such as, for example, when the automatic mode is "disabled" or tensing-sensing arrangement is not included in the device), or the motor-driven automatic mode as described above. FIG. 7 illustrates in detail an exemplary line leveler arrangement 60 that functions to evenly distribute cord 16 across take-up reel 12 as cord 16 is re-wound. FIGS. 1, 5 and 6 also illustrate line leveler arrangement 60 as it operates in conjunction with the other elements of the inventive diver's reel 10 of the present invention. For the sake of clarity, FIG. 7 omits several of these other elements so that the operation of line leveler arrangement 60 may be clearly understood.

With reference to FIG. 7, a drive gear 62 disposed at the bottom of first cavity 24 is coupled with a gear 37 attached to the underside of second gear 36 (second gear 36 shown in phantom), so that when motor 28 activates second gear 36, drive gear 62 will begin to rotate as well. Drive gear 62 will then turn a series of intermeshed gears 64. Gears 64 then function to turn a line leveler worm gear 66, where gear 66 includes a series of grooves 68. A line leveler pawl 70 is disposed over worm gear 66 and engages grooves 68. The rotation of worm gear 66 thus results in providing linear "up" and "down" motion to pawl 70, as shown by the double-ended arrow. In accordance with the present invention, U-shaped cord guide 46 is attached to pawl 70 in the manner best shown in FIG. 7, so that as pawl 70 moves up and down along worm gear 66, U-shaped cord guide 46 will evenly distribute cord 16 across the extent of take-up reel 12. As mentioned above, and shown in FIG. 7, U-shaped cord guide 46 includes a "bent" termination 46-T which is in contact with cord 16 as it passes through guide 46, termination 46-T maintaining a degree of tension on cord 16 as it as guided. The linear motion of guide 46 along worm gear 66 results in guiding cord 16 evenly across the extent of reel 12.

Those skilled in the art will appreciate that numerous variations of the specific embodiments set forth above may be practiced without departing from the spirit of the invention, as defined by the claims hereinbelow.

What is claimed is:

1. An automated reel device for controlling the pay out of a diver's safety cord, the automated reel device comprising;

a water-tight housing attachable to a piece of diver's equipment' a take-up reel rotatably attached to the housing and including a predetermined length of safety cord wound therearound, with an interior termination attached to said take-up reel, and an exterior termination capable of being fixedly attached by a diver to a point of origin, the safety cord being unwound off of said take-up reel as the diver moves away from the point of origin;

a battery-operated motor disposed within said housing and coupled to said take-up reel through a gearing arrangement such that when the motor is activated the take-up reel rotates to re-wind slack safety cord; and a tension sensing mechanism disposed in proximity to both the battery-operated motor and the take-up reel such that upon sensing slack in the safety cord, the tension-sensing mechanism functioning to: (1) activate the battery-operated motor and impart rotation of said take-up reel; and (2) de-activate the battery-operated motor when the slack along the safety cord is eliminated.

2. The automated reel device as defined in claim 1, wherein the tension sensing mechanism comprises a spring-loaded guide rod in contact with the safety cord and a magnetic switch for controlling the motor activation, where the guide rod is biased by a spring to remain separated from the magnetic switch as long as tension exists in the safety line, such that as the safety line goes slack, the spring-loaded guide rod will compress and contact the magnetic switch and in turn activate the motor.

3. The automated reel device as defined in claim 1, wherein the reel is disposed adjacent to the water-tight housing.

4. The automated reel device as defined in claim 1, wherein the device further comprises a manual override switch in electrical communication with the magnetic switch and the motor such that the operation of the tension sensing mechanism can be turned off so as to allow for a diver to manually control the operation of the take-up reel.

5. The automated reel device as defined in claim 4, wherein the device further comprises a visible indicator coupled to the manual override switch, which is activated when the manual override switch is turned "on" so as to provide a visual indication to a diver that the motor is disconnected from the take-up reel.

6. The automated reel device as defined in claim 1, wherein the device further comprises a line leveler arrangement disposed in association with the take-up reel to control the winding and unwinding of the safety line onto and off of said take-up reel in a manner that evenly distributes the safety line across the extent of said take-up reel.

7. The automated reel device as defined in claim 6, wherein the line leveler arrangement comprises:

a line leveler worm gear disposed parallel to an axis of the take-up reel;

a pawl disposed to ride back and forth within the worm gear;

a series of intermeshed gears to rotate the line leveler worm gear as driven by a drive gear on the take-up reel and driven by the motor; and a line guide loop attached to the pawl, wherein the safety cord is disposed through the line guide loop so that as the motor turns the series of intermeshed gears, the worm gear and pawl will move the line guide loop in a linear fashion across the axis of the take-up reel so as to evenly distribute the cord across said take-up reel.

8. The automated reel device as defined in claim 7, wherein the line guide loop comprises a U-shaped guide loop including a right-angle bend in its "U" termination such that the safety cord is in contact with the right-angle bend providing a desired degree of tension against the cord as it moves against the U-shaped guide loop.

9. A line leveler arrangement for use with a diver's take-up reel, the line leveler comprising:

a line leveler worm gear disposed parallel to an axis of the reel;

a pawl disposed to ride back and forth within the worm gear;

a series of intermeshed gears to rotate the line leveler worm gear as driven by a drive gear on the take-up reel, the take-up reel manually rotated by a diver; and a line guide loop attached to the pawl, wherein the safety cord is disposed through the line guide loop so that as the diver manually rotates the take-up reel, the series of intermeshed gears, the worm gear and pawl will move the line guide loop in a linear fashion across the axis of the take-up reel so as to evenly distribute the cord across said take-up reel.

10. The line leveler arrangement as defined in claim 9, wherein the line guide loop comprises a U-shaped guide loop including a right-angle bend in its "U" termination such that the safety cord is in contact with the right-angle bend, the right-angle bend providing a desired degree of tension against the cord as it moves against the U-shaped guide loop.

* * * * *